United States Patent [19]

Sato

[11] 4,253,393

[45] Mar. 3, 1981

[54] METHOD OF MARKING HOT MATERIAL AND APPARATUS THEREFOR

[75] Inventor: Akimone Sato, Kurashiki, Japan

[73] Assignee: Kawasaki Steel Corporation, Kobe, Japan

[21] Appl. No.: 924,691

[22] Filed: Jul. 14, 1978

[30] Foreign Application Priority Data

Mar. 13, 1978 [JP] Japan ..... 53/29097

[51] Int. Cl.[3] ..... B41M 1/12; B41F 17/00

[52] U.S. Cl. ..... 101/35; 164/DIG. 6; 118/301; 101/114; 101/129

[58] Field of Search ..... 101/121, 123, 127.1, 101/129, 50, 125, 114, 126, 35; 118/301, 504, 213; 164/100, 229, DIG. 6; 51/310–312; 427/272, 282

[56] References Cited

U.S. PATENT DOCUMENTS

| | | | |
|---|---|---|---|
| 3,007,396 | 11/1961 | Govan | 101/121 |
| 3,143,960 | 8/1964 | Naczynski | 118/301 |
| 3,251,298 | 5/1966 | Rudolph | 101/123 |
| 3,361,110 | 1/1968 | Szczepanski | 118/301 |
| 3,411,440 | 11/1968 | Johnston | 101/123 |
| 3,459,125 | 8/1969 | Forslund | 101/123 |

*Primary Examiner*—Edgar S. Burr
*Assistant Examiner*—A. Heinz
*Attorney, Agent, or Firm*—Koda and Androlia

[57] ABSTRACT

A combustible stencil held by holders is disposed at a position some distance apart from the end face of a hot material; immediately thereafter, a coating composition is sprayed onto the hot material through perforations in the stencil from behind to carry out the marking; the stencil is used only once and burned by the potential heat of the hot material upon marking; and a new stencil is used each time for marking. The combustion starting time is controlled by previously moistening the stencil as necessary.

8 Claims, 6 Drawing Figures

METHOD OF MARKING HOT MATERIAL AND APPARATUS THEREFOR

BACKGROUND OF THE INVENTION

1. Field of the Invention

The present invention relates to a hot material marking apparatus for marking identification signs onto hot materials such as slabs and blooms being conveyed on a conveying course in a blooming mill or a continuous iron foundry.

2. Description of the Prior Art

For identification in the succeeding process, a hot material is required to be marked thereon numerals and letters of about ten figures.

Despite that hot materials have an ambient temperature ranging from several hundred to one thousand and several hundred degree C, it is possible to carry out reliable marking by use of a coating composition having high heat resistance and good adhesiveness which is made of a ceramic material, without the possibility of disappearing, or falling off after cooling.

As a marking apparatus of using the above coating composition, there has been proposed a marking apparatus constructed such that: repeated use type stencils made of elongated thin metal plates are prepared in a number equal to the number of the figures to be marked, which are each penetratingly provided therein with a necessary numeral or letter and each connectd at opposite end portions thereof in the longitudinal direction to each other so as to be formed into a ring; the stencils thus prepared are loosely coupled onto a cylindrical drum to be rotatable on the axis of the drum; and nozzles provided in the drum are adapted to inject the coating composition onto a hot material through perforations formed in the stencils.

However, with the proposed marking apparatus, the coating composition adheres to portions of the perforations adjacent to the stencils during use and are solidified due to the high temperature of the hot material, the areas of the perforations are substantially decreased to result in unclear marking, repeated use of the stencils become difficult, considerable time is required for repairing and the like, and extra labor is needed for continuous work. Additionally, there has been proposed a marking apparatus in which a large amount of cleaning water is used to prevent the coating composition from being adhered, but in reality, it was impossible to achieve the purpose.

Despite that coating compositions withstanding the adverse conditions caused by hot materials have been developed, the marking has been really carried out after the hot materials have been cooled because there has been no practicable marking method and apparatus therefor.

SUMMARY OF THE INVENTION

In view of the above facts, one object of the present invention is to provide a method of marking on a hot material and an apparatus therefor, by which correct marking can be carried out onto a hot material.

The method of marking on hot materials according to the present invention has made it possible to make correct marking by use of a combustible stencil which had been deemed unusable heretofore because the combustible stencil was immediately burned by potential heat of the hot material. In other words, the present inventor noticed the fact that, if a combustible stencil such as paper is caused to approach the hot stencil, several seconds are required for burning up and applied this fact to the invention. As the result, according to the present invention, the coating composition is sprayed for marking within several seconds during which the combustible stencil is burned up, clear marking is made possible by use of a new stencil which is used only once and then thrown away, and further, the additional disposal of the stencil is dispensed with by burning up the stencil.

The apparatus for marking hot materials according to the present invention is constructed such that, when arms of a truck are disposed at horizontal positions, a stencil supplied from stencil supply means is held by holders installed on the arms, the arms are rotated from a horizontal positions to a position slightly upwardly turned from the horizontal direction, to thereby move the truck from the stencil supply means to a hot material conveying line, the arms are rotated to vertical positions to thereby abut a stopper installed on the forward end of one of the arms against a hot material, the combustible stencil is held at a given interval from the hot material, and the coating composition is horizontally sprayed onto the stencil from a spray nozzle installed on the arm by way of a rotary shaft to thereby carry out marking on the end face of the hot material, whereby the combustible stencil used only once and then thrown away is caused to approach the hot material only at the time of spraying the coating composition, thereby enabling to always carry out clear marking.

DESCRIPTION OF THE PREFERRED EMBODIMENT

Description will hereunder be given of one embodiment of the present invention with reference to FIGS. 1 through 4.

Figure 1:
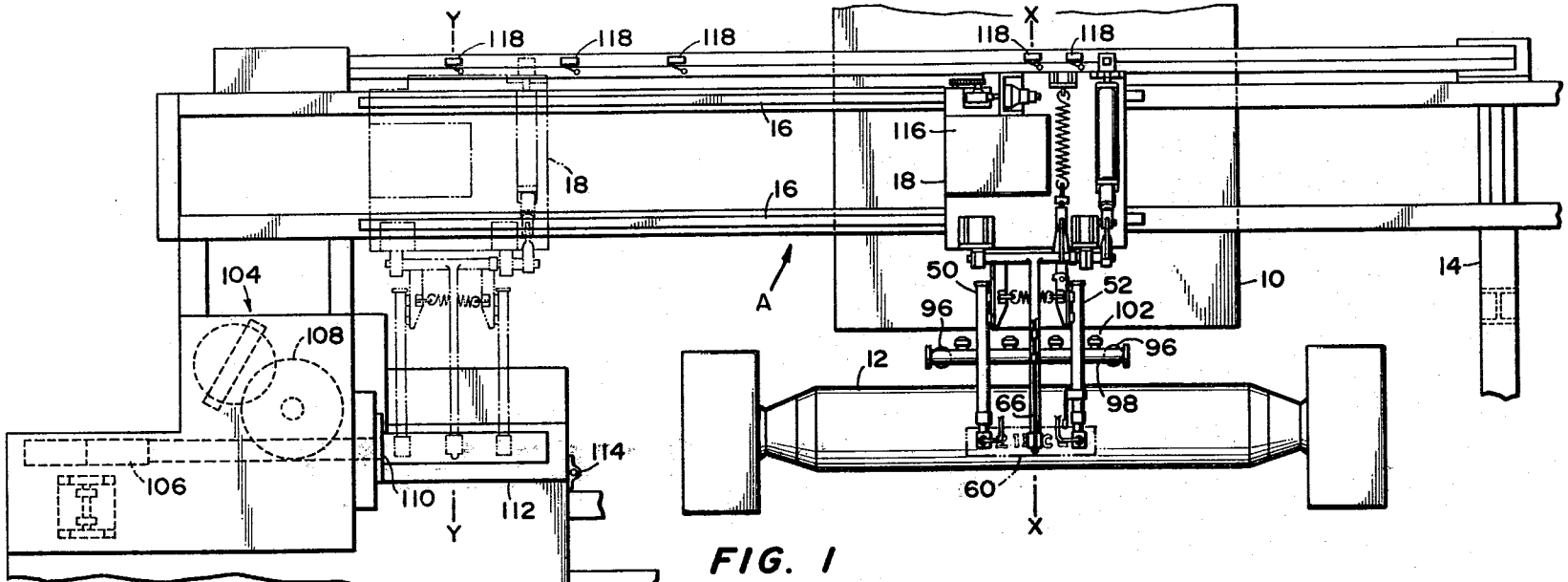
FIG. 1 is a plan view showing one embodiment of the apparatus for marking the hot material according to the present invention.

In FIG. 1, a line X—X is the blooming line, i.e. the center line of the hot material conveying course. A slab 10, a blooming unit, intermittently delivered through a mill not shown has the irregular portions at the forward and rear ends thereof cut off by a shearing machine disposed upstream, which is not shown, and thereafter, is conveyed by a roller table 12 to the direction indicated by an arrow A.

A frame 14, in which a plurality of H beams are secured to one another to form a gate, strides across the blooming roll line X—X as the framework of this apparatus at the intermediate portion of the blooming roll line. Laid perpendicularly to the blooming roll line X—X on the frame 14 are rails 16 for allowing a truck 18 to travel thereon.

Figure 3:
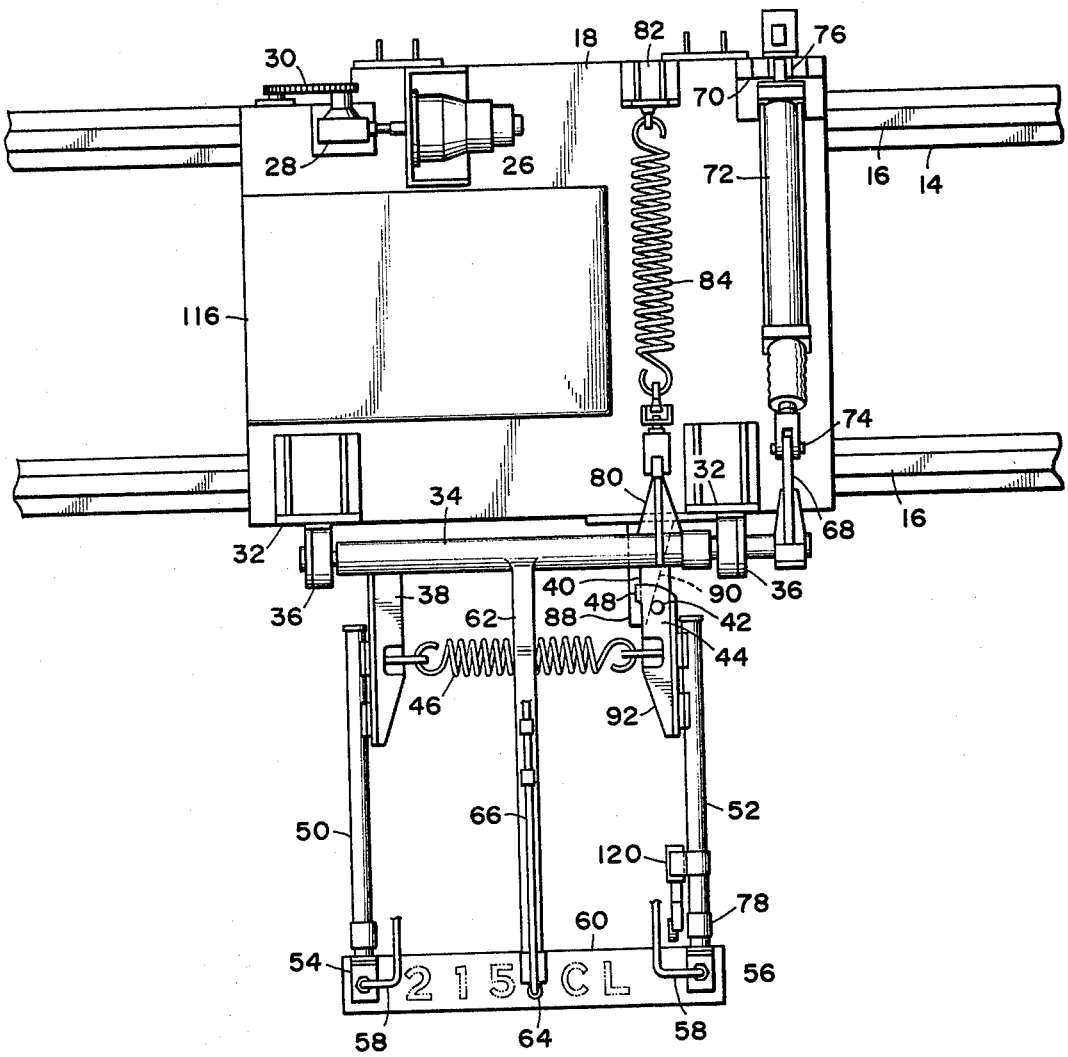
FIG. 3 is an enlarged view showing the truck.
Figure 4:
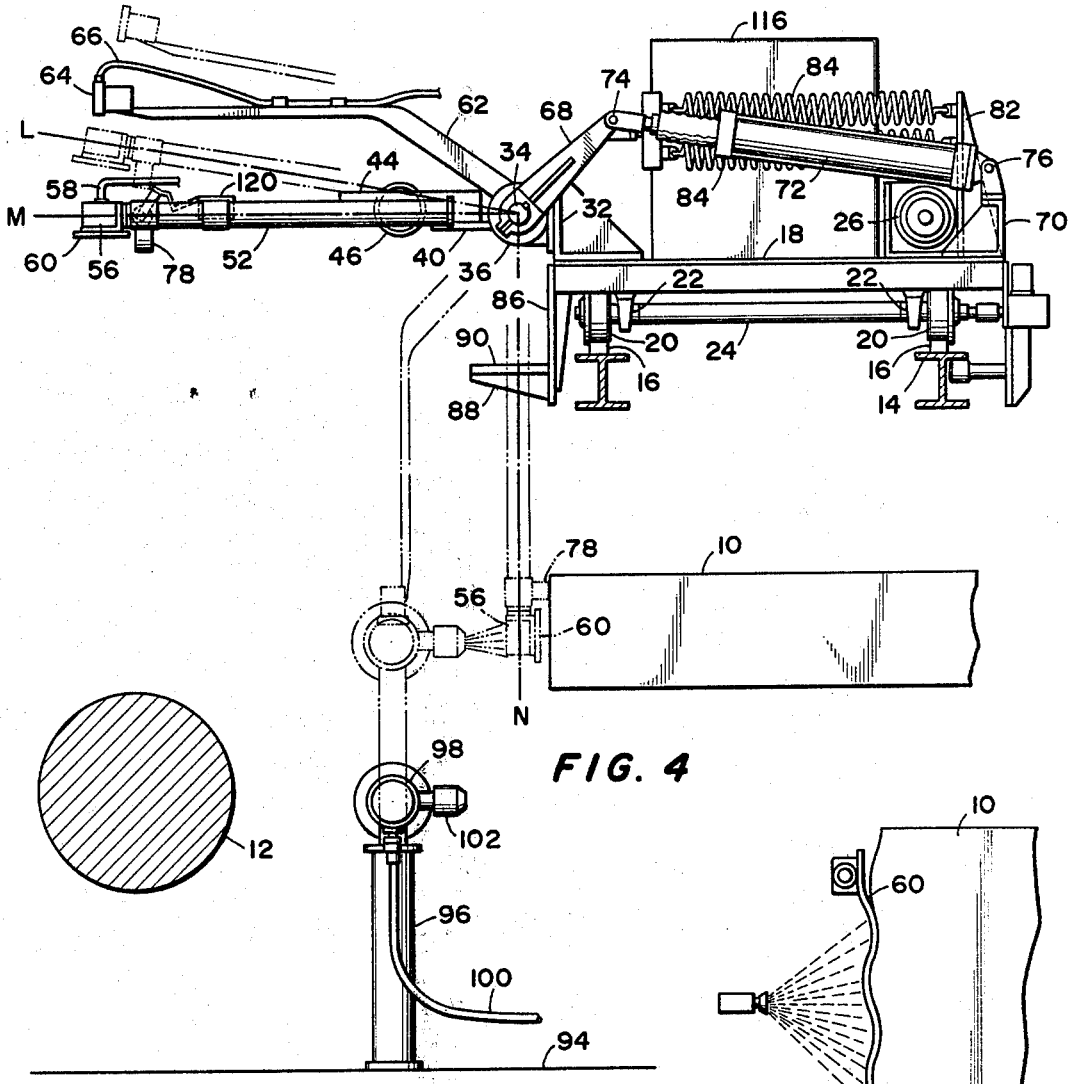
FIG. 4 is a sectional view taken along the line IV—IV in FIG. 2.

As detailedly shown in FIGS. 3 and 4, four wheels 20 to be mounted on the rails 16 are solidly secured to opposite ends of axles 24 pivoted on the truck 18 through bearings 22. Driving force is transmitted to the axles 24 from a motor 26 provided on the truck 18 through a reduction gear box 28 and a chain 30, so that the truck 18 can travel on the rails 16 in the direction perpendicular to the blooming roll line X—X.

Fixed at the forward portion of the truck 18 are a pair of brackets 32, on both of which a rotary shaft 34 is pivotted through bearings 36. Welded to this rotary shaft 34 at a suitable interval are brackets 38, 40. A bracket 44 is pivoted on the bracket 40 through a pivot 42. Accordingly, the bracket 44 rotates on the pivot 42 to go away from the bracket 38. However, the bracket 44 is biased in the direction of approaching the bracket 38 by the biasing force of a tension coil spring 46, and a stopper 48 projecting from the bracket 44 abuts against the bracket 40 to thereby stop the bracket 44. Ends of a pair of swivel arms 50, 52 are welded to the aforesaid brackets 38, 44, respectively. These swivel arms are made of pipe materials, the axis thereof are disposed perpendicular to the axis of the rotary arm 34, and are provided at the forward portions thereof with attracting heads 54, 56. Connected to these attracting heads 54, 56 are negative pressure pipes 58 communicated with a negative pressure generator, whereby a stencil 60 made of paper is adapted to be held under negative pressure.

Welded to the intermediate portion in the axial direction of the rotary shaft is a bracket 62, on the forward end of which is installed a gun 64 for spraying the coating composition, whereby the coating composition delivered under pressure from a coating composition pressure feed apparatus not shown through a coating composition pressure feed pipe 66 is adapted to be injected perpendicularly onto the surface of the stencil 60 made of paper.

Additionally, a small arm 68 is solidly secured to one end portion of the rotary shaft 34. Pivotally supported between the forward end portion of this small arm 68 and a bracket 70 erected at the rear portion of the truck 18 through pivots 74, 76 is a hydraulic cylinder 72 which is adapted to rotate the rotary shaft by way of the small arm 68 when driven by a driving means not shown. The driving force of the hydraulic cylinder 72 is so controlled that the rotation of the rotary shaft 34 can rotate through a slightly larger than a right angle from a position L where the axes of the swivel arms 50, 52 are slightly upwardly turned from the horizontal direction, through a position M in the horizontal direction to a position N in the vertical direction. When the arms 50, 52 are directed vertically, the axis of the gun 64 for spraying the coating composition is adapted to be horizontal.

To correctly stop the swivel arms 50, 52 at the vertical position N, the swivel arm 52 is provided with a stopper 78. As shown in FIG. 4, when the forward end of this stopper 78 abuts against the end face of the slab 10, the stencil 60 attracted onto the attracting heads 54, 56 is adapted to be some distance (preferably 10 mm) apart from the end face of the slab 10. The slab 10 in FIG. 4 is located at the marking position. Stopping the slab 10 at this marking position may be made easily by stopping a driving motor not shown of the roller table 12 as necessary receiving a signal from a slab position detector such as a limit switch. It is possible to interlock this driving motor of the roller table with the motor 26 of the truck 18, so that the truck 18 can be stopped on the blooming roll line X—X as shown in FIG. 1 with the slab 10 being stopped at the position shown in FIG. 4.

In passing, as for the stopper 78, a bolt, in which the value of threadable coupling to the arm 50 or 52 is changeable, may be used, so that the interval between the stencil 60 made of paper located at the position N and the end face of the slab 10 can be adjusted as necessary.

A small bracket 80 is solidly secured to the rotary shaft 34. Stretched between the small bracket 80 and a bracket 82 erected at the rear portion of the truck 18 are two tension coil springs 84. The swivel arms 50, 52 are biased by the biasing force of the spring 84 in a manner to rotate in the clockwise direction in FIG. 4, i.e. to the direction of the position L, so that the swivel arms 50, 52 can be located at the position L when the hydraulic system of the hydraulic cylinder 72 is out of order.

Further, hanging down from the forward surface of the truck 18 is a bracket 86 to which is solidly secured a cam 88. A slant surface 90 of this cam 88 is shaped to serve as a cam surface, which is adapted to abut against the bracket 44 installed on the rotary shaft 34 through a bracket 40. Namely, the bracket 44 approaches the bracket 88 by the rotation of the swivel arms 50, 52, and the slant surface 92 of the bracket 44 abuts against the slant surface 90 immediately before the position N. Thereafter, if the rotation further progresses, then the bracket 44 is rotated on a pivot 42 in the counterclockwise direction in FIG. 3 against the biasing force of the spring 46, to thereby cause the attracting heads 54, 56 to be separated from each other. The separation of the attracting heads 54, 56 gives tension to the stencil 60 made of paper moistened by the absorption of moisture, to thereby remove deflection.

Figure 2:
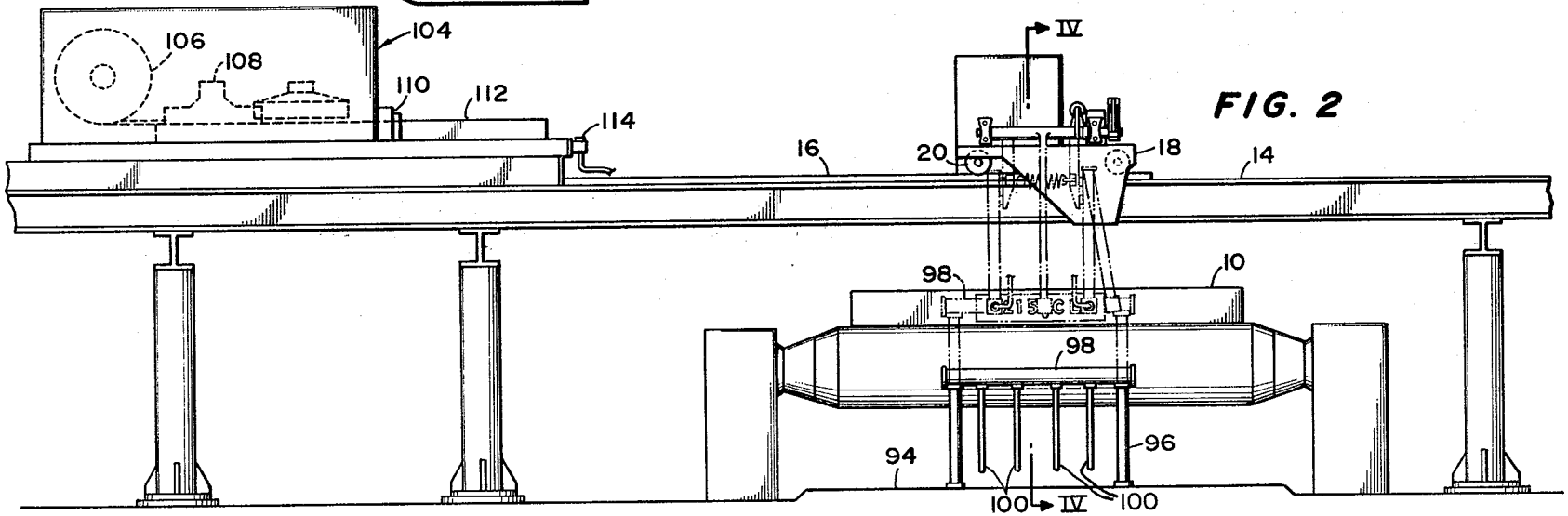
FIG. 2 is a front view thereof.

Next, as shown in FIGS. 1, 2 and 4, provided beneath the front end face of the slab 10 stopped at the marking position and disposed on a base 94 are a pair of cylinders 96 which is adapted to be able to drive a header 98, a descaling device, in the vertical direction. Horizontally disposed on this header 98 are a plurality of nozzles 102 communicated with a water supply hose 100, said header 98 being able to inject water onto the end face of the slab 10 at the elevated position thereof as shown by two-dot chain lines in FIG. 4.

This header 98 is elevated at the same time as the slab 10 stops at the marking position, can remove the scale and decrease the temperature of the end face of the slab temporarily. Thereupon, the cylinder 96 is driven again to lower the header to a position indicated by solid lines in FIG. 4, and at the same time, the arms 50, 52 holding the stencil 60 is turned to the position N.

Next, as shown in FIG. 1, the aforesaid truck 18 travels on the rails 16 and moves onto a line Y—Y disposed in parallel with the blooming roll line X—X, and is adapted to receive the punched stencil from a stencil supply device 104. This stencil supply device is a known device 104 and includes a stencil coil 106 incorporating therein an unwinder, a puncher 108, a shear cutter 110 and a horizontal guide 112. A paper stencil unwound from the stencil coil has punched thereon necessary letters and numerals by the puncher 108, is delivered onto the horizontal guide 112, and cut to required length by the shearing cutter 110. Since this horizontal guide 112 is separated from the blooming roll line X—X, there is no possibility of the stencil being subjected to thermal effect of the slab 10 upon being punched.

The punched stencil delivered onto this horizontal guide 112 is so determined in the dimensions thereof that, when the swivel arms 50, 52 are brought to the horizontal position M, the attracting heads 54, 56 become flush with the stencil, and the paper stencil is transferred from the horizontal guide 112 to the attracting head 54, 56 under negative pressure. Furthermore, such a consideration is rendered in design that the arms 50, 52 holding the paper stencil on the line Y—Y as described above are turned to the slightly upwardly turned position L by the driving force of the hydraulic cylinder 72 while the truck 18 moves to the blooming roll line X—X, thereby preventing the stencil being held to interfere with other components.

In addition, a water spray nozzle 114 installed on the frame 14 and whose axis is substantially vertical is disposed adjacent to this horizontal guide 112, communicated with a water supply source not shown, carries out injection of water onto the stencil 60 passing by after having been caught by the arms 50, 52, to properly moisten the stencil 60, thereby enabling to delay the combustion starting time of the stencil 60 to some extent.

Mounted on the truck 18 is a sequential controller 116 for controlling the operations of a motor 26 for driving the truck, the hydraulic cylinder 72, the gun 64 for spraying the coating composition, the cylinders 96 of the header 98 for descaling, the stencil supply device 104 and the like. A plurality of limit switches 118 are disposed along the rails 16 which detect the position of the truck 18 and controlling the hydraulic cylinder 72 for turning the arms 50, 52, and the like. A limit switch 120 abutting against the slab 10 and sensing the vertical position of the swivel arm 52 is installed on the swivel arm 52.

Description will hereunder be given of operation of the present embodiment. As for the slabs 10, the pressure roll schedule is predetermined in the blooming mill or the like, and hence, an order from a computer for administering the mill (not shown) is sent to the stencil supply device 104. By this order, the stencil in the stencil coil 106 is unwound and has punched thereon necessary letters and numerals by the puncher 108.

This stencil 60 is punched, delivered onto the horizontal guide 112 and cut to required length by the shearing cutter 110 before the slab 10 cut to required length reaches the marking position shown in FIG. 1 on the milling roll line X—X.

Here, in the truck 18, the motor 26 is driven by a sequential controller in accordance with a signal from a limit switch for detecting the approach of the slab 10 to the marking position, whereby the truck 18 travels on the rails 16 to the line Y—Y. At the same time as above, the hydraulic cylinder 72 turns the swivel arms 50, 52 from the position L to the horizontal position M, and the attracting headers 54, 56 catch and hold the substantially opposite end portions of the stencil 60 which has been punched. Thereafter, the cylinder 72 moves the swivel arms 50, 52 to the position L slightly upwardly turned from the horizontal direction again, and the motor 26 rotates in the reverse direction to move the truck to the blooming roll line X—X. During this movement, the stencil is moistened by a water spray nozzle 114.

On the other hand, upon the reaching of the slab 10 to the marking position, the cylinders 96 vertically moving the header 98, the descaling device, elevate the header to a position indicated by two-dot chain lines shown in FIG. 4. Here, water under pressure from the water supply hose 100 is fed to the header 98, injected onto the end face of the slab 10 by the nozzle 102, whereby the scale produced on the end face of the slab 10 is removed and the temperature at the end face of the slab is temporarily lowered.

This header 98 is lowered again by the reverse rotation of the cylinder 96, whereby the cylinder 72 of the truck 18 is immediately driven to thereby turn the swivel arms 50, 52 to the vertical position N. At this position N, the bracket 42 abuts against the cam 88, whereby the swivel arm 52 rotates in the direction of being separated from the swivel arm 50, and the attracting head 56 is separated from the attracting head 54 to a certain extent. Consequently, the moistened stencil 60 held at the opposite ends thereof by the attracting heads 54, 56 is given with tension so that the deflection due to the elongation by the moistening is removed.

Additionally, along with the stencil 60 being given with tension, the stopper 78 abuts against the end face of the slab, whereby the attracting heads 54, 56 of the swivel arms 50, 52 each hold a desired distance from the end face of the slab, so that the whole surface of the stencil 60 can hold the distance from the end face of the slab uniformly.

Figure 5:
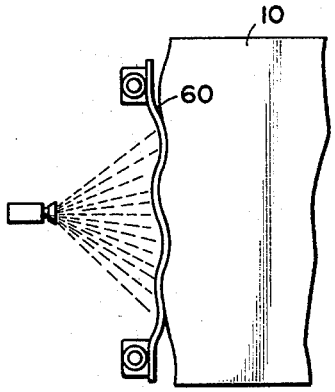
FIG. 5 is a plan view showing the condition of spraying the coating composition.

Thus, the coating composition is horizontally injected from the gun 64 for spraying the coating composition by an order sent from the sequential controller 116, to thereby carry out the marking through the perforations of the stencil 60. Under the pressure of spraying the coating composition, the intermediate portion of the stencil 60 comes in contact with the end face of the slab for the first time. For the case wherein the end face of the slab 10 has an irregular surface, as shown in FIG. 5, it is possible by allowing the stencil to come in contact with the irregular surface to insure that the letters and numerals are clear.

In several seconds after the spraying of the coating composition as described above, the stencil 60 starts to be burned by the potential heat of the slab 10. When the pressure in the attracting heads is changed to positive pressure to stop holding the stencil, the stencil drops down and disappears, and the disposal of the stencil can be dispensed with.

Thereafter, the truck 18 is caused to travel on the rails 16 in the reverse direction, and stopped on the line Y—Y in FIG. 1. At the same time as above, the swivel arms 50, 52 are turned to the position L in FIG. 4 to await the succeeding marking. Thereafter, everytime the slab 10 is intermittently conveyed on the blooming roll line X—X, the above operation is repeated, thereby enabling to carry out the clear marking of a desired item by use of a new stencil each time.

Figure 6:
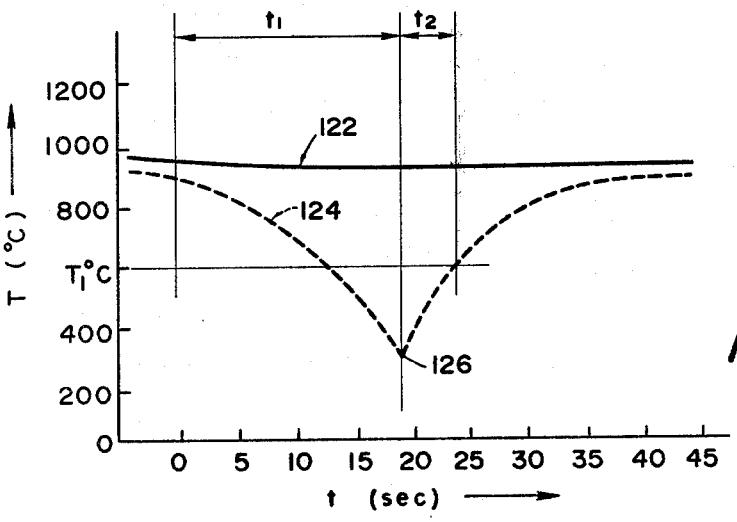
FIG. 6 is a diagram showing the temperature on the end face of the slab with time in the case of water-spraying on the end face of the slab.

Description will hereunder be given of one example of the relationship between the temperature (T° C.) at the end face of the slab 10 and the elapsed time (t sec) with reference to FIG. 6. A curve 122 in the drawing is the cooling curve of the interior of the slab 10, a broken line 124 is the curve indicating the temperature (T° C.) at the end face of the slab 10, onto which water is injected by the header 98, a temperature $T_1$° C. is the temperature, at which the paper stencil 60 starts to be burned, varies depending upon the thickness of paper and the extent of contact, and normally about 500° to 600° C. The curve shown in FIG. 6 is one example thereof and varies mainly depending upon the heat capacity of the hot material, the water injection time $t_1$, the injection pressure and the water injection flow rate.

If water is injected continually for sec. $t_1$ onto the end face of the slab 10, the temperature at the end face of the slab 10 gradually decreases to the lowest temperature curve 126 which is lower than $T_1$° C. Thereafter, if the water injection is stopped, then the temperature at the outer surface of the slab 10 gradually increases by the potential heat of the slab 10 to $T_1$° C. in sec. $t_2$, and further increases. Consequently, it is necessary to carry out the operation within sec. $t_2$ which includes causing the paper stencil 60 to approach the end face of the slab, spraying the coating composition, and completing the marking. Since the sec. $t_2$ described above can be set at a desirable value by changing the time $t_1$ of injecting water onto the end face of the slab, the injection pressure and the water injection flow rate, and is actually five to ten sec. as shown in FIG. 6, such a paper stencil is usable as to start to be burned in eight to fifteen sec. after approaching the outer surface of the slab 10 and have a thickness ranging from 0.5 to 1.0 mm. Additionally, the combustion starting time can be controlled by the extent of moistening by the water spray nozzle 114.

Furthermore, the time interval of sec. $t_1$ described above varies depending upon the temperature of the hot material, the water injection pressure and the flow rate of water, and is preferably about 10 to 30 sec. The water injection pressure in this case is preferably so high as to flow away the minute scale starting to come off due to thermal shrinkage, and about 5 to 30 kg/cm$^2$ is satisfactory.

In addition, in the above embodiment, description has been given of the apparatus in which the attracting heads 54, 56 hold the stencil 60 under the negative pressure. However, it must be understood that the foregoing description is intended to be illustrative only and not limitative of the present invention. Such means as to hold the stencil by pressing pawls into the stencil may be used, and any stencil holder having the quality of withstanding the heat of the slab 10 is applicable.

What is claimed is:

1. An apparatus for marking hot materials such as slabs and blooms which are moving on a conveying course, wherein said apparatus comprises:

a stencil supply device having means for producing and supplying stencils spaced apart from said conveying course of said hot materials;

a truck movable in a direction perpendicular to said conveying course between said conveying course and said stencil supply device;

a pair of elongated swivel arms rotatably supported by the truck;

a nozzle movable integrally with said swivel arms for spraying a coating composition from behind the stencil;

holders provided at forward portions of said arms respectively, for holding substantially opposite end portions of the stencil; and driving means provided on said truck for rotating said arms from a first position wherein said forward portions of said arms are above a horizontal plane as said truck approaches said stencil supply device to a second position wherein said arms are in a substantially horizontal position when said truck is at said stencil supply device where said holders receive the stencil from said stencil supply device and to a third position wherein said arms are in a vertical position when said truck is at said conveying course and where the stencil held is caused to approach an end face of the hot material onto which the marking is carried out.

2. An apparatus for marking a hot material, as set forth in claim 1, characterized in that:

said swivel arms having a stopper which abuts against the end face of the hot material to thereby control the angle of turn of the swivel arms.

3. An apparatus for marking a hot material, as set forth in claim 1, characterized in that:

said apparatus is further provided with a descaling device for removing the scale and cooling the end face of the hot material by spraying water onto said end face prior to the marking.

4. An apparatus for marking hot material, as set forth in claim 3, characterized in that:

said descaling device comprises a header communicating with a water supply via a hose and a cylinder for vertically moving said header whereby said header is vertically oscillated to a position adjacent an end face of the hot material and a position subjacent an end of the hot material.

5. An apparatus for marking a hot material, as set forth in claim 1, characterized in that:

said holders hold substantially opposite end portions of the stencil under negative pressure.

6. An apparatus for marking a hot material, as set forth in claim 1, characterized in that:

the holder provided on the forward portion of the swivel arms are biased by resilient force in a direction to separate the holders from the end face of the hot material.

7. An apparatus for marking a hot material, as set forth in claim 1, characterized in that:

one of the pair of the swivel arms is rotatable in a direction to separate it from the other arm when in said vertical position thereby tensioning the stencil held by the swivel arms.

8. An apparatus for marking a hot material, as set forth in claim 7, characterized in that:

said arms are caused to separate by abutting a cam installed on said truck against one of the swivel arms.

* * * * *

UNITED STATES PATENT AND TRADEMARK OFFICE

CERTIFICATE OF CORRECTION

PATENT NO. : 4,253,393

DATED : Mar. 3, 1981

INVENTOR(S) : Akimune Sato and Tsuyoshi Tsuchida

It is certified that error appears in the above—identified patent and that said Letters Patent is hereby corrected as shown below:

At [75] Inventor:, change "Akimone Sato" to --Akimune Sato-- and add --Tsuyoshi Tsuchida--.

At [30] Foreign Application Priority Data, add --Mar. 22, 1978 [JP] Japan.....53/37109--.

Signed and Sealed this

*Seventh* Day of *July 1981*

[SEAL]

*Attest:*

RENE D. TEGTMEYER

*Attesting Officer*

*Acting Commissioner of Patents and Trademarks*